United States Patent [19]

Douglas et al.

[11] 3,981,726

[45] Sept. 21, 1976

[54] ELECTRICAL CONTACT MATERIALS

[75] Inventors: Peter Douglas; David John Pedder; Peter John Swallow; Terrence Ardern Davies, all of Northampton, England

[73] Assignee: Square D Company, Park Ridge, Ill.

[22] Filed: June 13, 1975

[21] Appl. No.: 586,763

Related U.S. Application Data

[62] Division of Ser. No. 384,161, July 30, 1973, Pat. No. 3,922,236.

[30] Foreign Application Priority Data

Aug. 1, 1972 United Kingdom ..... 35826/72

[52] U.S. Cl. ..... 75/206; 75/211; 75/200; 29/420.5; 252/514; 252/521

[51] Int. Cl.[2] ..... B22F 1/00; B22F 3/00

[58] Field of Search ..... 75/206, 211, 200; 29/420.5; 252/514, 521

[56] References Cited

UNITED STATES PATENTS

| | | | |
|---|---|---|---|
| 3,385,677 | 5/1968 | Schreiner | 252/512 |
| 3,506,437 | 4/1970 | Gwyn, Jr. | 75/206 |
| 3,630,968 | 12/1971 | Hamano | 252/521 |

*Primary Examiner*—Brooks H. Hunt

*Attorney, Agent, or Firm*—Harold J. Rathbun; Paul J. Rose

[57] ABSTRACT

An electrical contact material which consists of a mixture of silver, 5 to 50 weight per cent of copper and 2 to 20 weight per cent of lanthanum, strontium chromite of formula $La_{1-x}Sr_xCrO_3$, where the values of $x$ lie between 0 and 1.0, formed as a hard, chemically inert, non-metallic phase of high electrical conductivity both within the bulk of, and at the surface of, the contact material. Methods of producing the electrical contact materials utilizing powder metallurgical techniques are outlined.

11 Claims, No Drawings

ELECTRICAL CONTACT MATERIALS

This is a division of application Ser. No. 384,161, filed July 30, 1973 now Pat. No. 3,922,236.

The invention relates to electrical contact materials for use in electrical contacts and to methods of producing the electrical contact materials.

Electrical contact materials which consist of a mixture of silver and copper are known; the copper constituent being used because of its hardness and resistance to wear in comparison with pure silver. It is also known that the tarnish resistance and electrical conductivity of these silver/copper alloys decrease with increase in copper content.

It is an object of the present invention to provide an electrical contact material for the fabrication of electrical contacts with prolonged reliable continuity of electrical conductivity across the interface between its contact surface and the metal surface it is contacting under all environmental conditions.

The invention provides an electrical contact material which consists of a mixture of silver, 5 to 50 weight per cent of copper and 2 to 20 weight per cent of lanthanum, strontium chromite of formula $La_{1-x}Sr_xCrO_3$, where the values of $x$ lie between 0 and 1.0, formed as a hard chemically inert, non-metallic phase of high electrical conductivity both within the bulk of, and at the surface of the contact material.

The invention also provides a method of producing an electrical contact material including the steps of providing irregular silver powder having a powder particle size of not greater than approximately 350 mesh; providing irregular copper powder having a powder particle size of not greater than 350 mesh; providing lanthanum, strontium chromite powder of formula $La_{1-x}Sr_xCrO_3$, where the values of $x$ lie between 0 and 1.0, and having a powder particle size of not greater than approximately 10 microns; mixing the powders together to provide a fine, evenly dispersed mixture containing 5 to 50 weight per cent of copper, 2 to 20 weight per cent of $La_{1-x}Sr_xCrO_3$ and the remainder silver; compacting the powder mixture into a desired shape; and sintering the compacted shape.

The foregoing and other features according to the invention will be better understood from the following description of specific embodiments of the invention.

An electrical contact material according to the invention which is especially adapted for light duty applications consists of a mixture of silver, 5 to 50 weight per cent of copper, and 2 to 20 weight per cent of lanthanum, strontium chromite of formula $La_{1-x}Sr_xCrO_3$ where the values of $x$ lie between 0 and 1.0. The $La_{1-x}Sr_xCrO_3$ forms as a hard, chemically inert, nonmetallic phase of high electrical conductivity both within the bulk of, and at the surface of, the contact material.

The $La_{1-x}Sr_xCrO_3$ non-metallic phase which is present in the contact material as a fine dispersion of discrete particles, the mean particle size not exceeding approximately 10 microns, possess the following properties:

a. The phase has a high electrical conductivity i.e. a specific resistivity within the range 1 to $10^{-3}$ohm.cm.

b. The phase is thermodynamically stable with respect to the environment and the matrix metal or alloy.

c. The phase possesses high thermal stability in order to withstand thermal treatments likely to occur during the fabrication of the contact piece part.

d. The phase is chemically inert.

e. The phase is harder than the tarnish films likely to form on the matrix metal or alloy; for example, oxide or sulphide films.

The $La_{1-x}Sr_xCrO_3$ non-metallic phase, will, therefore, form as a hard, chemically inert, nonmetallic phase of high electrical conductivity both within the bulk of, and at the surface of, the contact material.

The presence of the highly conductive, non-metallic phase at the surface of electrical contacts fabricated from the electrical contact material according to the invention effectively minimises the increase in contact resistance by providing highly conductive paths across the contacting interface.

Also tarnish films which may form on the electrical contact material will be disrupted by the harder, chemically inert, non-metallic phase at the contact surface so that electrical contact is maintained; the discrete islands of high conductive, non-metallic material effectively constitute anisotropic conducting paths through the otherwise electrically insulating tarnish film formed on the surrounding material.

In addition, the highly conductive, non-metallic phase enhances the tarnish resistance of the basic silver/copper alloy.

The electrical contact materials according to the invention can be fabricated by any one of several known techniques but are best fabricated by powder metallurgical techniques.

In a method according to the invention for producing an electrical contact material which consists of silver, copper and $La_{1-x}Sr_xCrO_3$, fine, irregular silver powder is intimately mixed with fine, irregular copper powder and $La_{1-x}Sr_xCrO_3$ powder to provide a fine, evenly dispersed mixture containing 5 to 50 weight per cent copper, 2 to 20 weight per cent of the non-metallic $La_{1-x}Sr_xCrO_3$ powder, and the remainder silver.

The size and shape of the powder particles are of prime importance in the manufacture of optimum contact materials and all the powders should preferably be as fine as is economically possible. This in practice involves the use of irregular silver and copper powders having a powder particle size of less than approximately 350 mesh and $La_{1-x}Sr_xCrO_3$ powder having a powder particle size of less than 10 microns and preferably less than 2 microns.

The use of fine powder ensures that a fine even dispersion of the powders is obtained in the finished contact material.

A typical commercially available silver powder which can be utilised is "Thessco" silver powder produced by Sheffield Smelting Company, a subsidiary of Engelhard Industries. This silver powder which is a precipitated powder of commercial purity is of irregular morphology, a powder particle size of less than 300 mesh and an apparent density of 1.9 gms/cc. This material also has (i) a geometric mean linear intercept by transmission microscopy of 17.8 microns, standard deviation 2.0 and (ii) a geometric mean linear intercept on a polished section of 4.1 microns, standard deviation 2.0. This commercially available silver powder is sieved before being used to remove the powder particles which are of a size greater than approximately 350 mesh.

The copper constituent should preferably be provided by clean, fine, dendritic copper powder of the specified particle size.

The lanthanum, strontium chromite ($La_{1-x}Sr_xCrO_3$) powder can for example, be produced by spray decomposition of La, Sr and Cr nitrates in stoichiometric proportions. The oxide mixture resulting from this process is then sintered in air for approximately ½ hour at a temperature of approximately 1,250°C. The sintered powder is then milled for 96 hours under acetone in an agate planetary miller and washed in dilute hydrochloric acid. This powder is free from impurities such as strontium chromate and has a submicron powder particle size.

It is important to note that these materials should be kept clean and dry in storage in order to prevent moisture absorption and surface oxidation (this is especially important for the silver and copper powders). The powder storage could for example be effected by the use of dessicators.

The intimate mixing of the silver, copper and $La_{1-x}Sr_xCrO_3$ powders can be effected by dry tumble milling. In order for the dry tumble milling to be effective for these powders it is important that the following mixing conditions are adhered to:

a. The constituent powders should have a particle size as specified in a preceding paragraph.

b. The powders should be dessicator stored, or stored with some alternative means being employed of preventing absorption of moisture and surface oxidation.

c. The volume to be mixed should be from 50 grams upwards; the actual mixing time being dependent upon the size of the mix.

d. The copper composition should be in the range 5 to 50 weight per cent and the $La_{1-x}Sr_xCrO_3$ non-metallic phase composition should be in the range 2 to 20 weight per cent.

e. The volume of the drum should be of the order of 2 to 10 times the volume of the powder being mixed in order to prevent the movement of the powder being restricted.

f. The relative humidity inside the drum should be in the range 0 to 70% and the inside drum temperature should be in the range 10° to 30°C.

g. The speed of rotation of the drum should be such that the powders are continually in motion during mixing. Increasing the speed of rotation of the drum will decrease the time required for good mixing. If the speed of rotation is excessive, however, then, due to the influence of centrifugal forces, mixing will be hindered.

h. The duration of powder mixing is generally dependent upon the copper and $La_{1-x}Sr_xCrO_3$ non-metallic phase content of the powder; the larger the copper and electrically non-metallic phase content the longer the mixing time.

It should, however, be noted that the most significant variable in attaining a fine uniform dispersion of the copper and the $La_{1-x}Sr_xCrO_3$ powders throughout the contact material is the absolute and relative sizes of the constituent powder particles and the optimum mixing schedule is largely determined by this factor.

Typical mixing conditions for the silver, copper and $La_{1-x}Sr_xCrO_3$ powders in mixing volumes in the range 50 to 1000 grams, a copper composition in the range 5 to 50 weight per cent and a $La_{1-x}Sr_xCrO_3$ non-metallic phase composition in the range 1.0 to 20 weight per cent are as follows:

a. The drum volume was of the order of 2 to 10 times that of the powders being mixed.

b. The mixing was carried out at 20°C (range 17°C to 23°C) with a relative humidity of approximately 60% (range 45 to 65%).

c. The drum was revolved at 160 r.p.m.

d. Two 5 hour mixing periods were carried out, the powder mixture being sieved, between the two mixing stages, through a sieve having apertures of approximately 53 microns.

These mixing conditions have been found for the particular powders employed to give a uniformly mixed composite powder.

The powder mixture is then compacted at a pressure of approximately 20 tons per square inch using moulds into the desired shape for the electrical contacts.

The powder compacts are then sintered by being heated in an atmosphere of 3% hydrogen/97% nitrogen gas mixture at a temperature of 750°C for a period of time of approximately one hour.

The processing schedule used results in some of the $La_{1-x}Sr_xCrO_3$ non-metallic material being present at the surface of the electrical contact where it stands proud of the surface as discrete islands of a hard, chemically inert, non-metallic phase of high electrical conductivity on a silver/copper sea.

The density of the contact material is then increased by a coining or stamping operation at a pressure of approximately 50 tons per square inch.

It should be noted that the temperature and pressure schedule of this method which produces contact compacts having a density of at least 98 per cent of the theoretical maximum density, represents the optimum schedule for the powder particle sizes outlined in the preceding paragraph. It is envisaged that this schedule, and in particular the compacting and stamping pressures, may be changed if finer powders of different morphology are utilised.

The presence of the highly conductive, non-metallic phase in the electrical contacts produced by the method according to the invention effectively minimises the increase in contact resistance previously referred to by providing highly conductive paths across the contacting interface and by inhibiting the tarnishing ability of the basic silver/copper alloy.

Also, the tarnishing films which, are previously stated, tend to form on the contact material are disrupted by the harder, chemically inert, non-metallic phase at the contact surface so that electrical contact is maintained by conducting phase to silver/copper or conducting phase to conducting phase contact; the discrete islands of highly conductive, non-metallic material effectively constitute anisotropic conducting paths through the otherwise electrically insulating oxide formed on the surrounding silver/copper material.

Examples of electrical contact materials produced by the method outlined in the preceding paragraphs in the form of domed electrical contacts are given below together with the associated contact resistance data. The electrical contacts were degreased in iso-propanol and subjected to accelerated tarnishing tests conducted in an atmosphere of moist air containing $H_2S$. The atmosphere consisted of 1000 ppm of $H_2S$ in moist air. The electrical contacts were exposed to this atmosphere for a period of approximately 10 minutes at room temperature. All the contact resistance measurements were made across the interface between the domed contact surface and a flat polished silver reference surface.

EXAMPLE 1.

Silver - 5 weight per cent copper - 5 weight per cent $La_{0.7}Sr_{0.3}CrO_3$.

This material, when compared with a silver - 5 weight per cent copper alloy exhibited a marked reduction in contact resistance after exposure to a tarnishing atmosphere as shown in the following table:

| Contact Material | Contact Resistance (ohms) at the following contact forces 30g | 100g |
|---|---|---|
| Silver - 5 weight percent Copper. | 0.024 | 0.0083 |
| Silver - 5 weight percent Copper - 5 weight percent $La_{0.7}Sr_{0.3}CrO_3$ | 0.0014 | 0.0009 |

EXAMPLE 2.

Silver - 10 weight per cent copper - 5 weight per cent $La_{0.7}Sr_{0.3}CrO_3$.

This material, when compared with a silver - 10 weight per cent copper alloy also exhibited a marked reduction in contact resistance after exposure to a tarnishing atmosphere as shown in the following table:

| Contact Material | Contact Resistance (ohms) at the following contact forces. 30g | 100g |
|---|---|---|
| Silver - 10 weight percent Copper. | 0.400 | 0.095 |
| Silver - 10 weight percent Copper - 5 weight percent $La_{0.7}Sr_{0.3}CrO_3$ | 0.017 | 0.0048 |

It can, therefore, be seen from the above that the electrical contact materials containing 5 weight per cent of $La_{0.7}Sr_{0.3}CrO_3$ exhibit more than an order of magnitude reduction in contact resistance, at all contact forces, compared with the basic silver/copper alloy.

The electrical contact materials given above were also exposed to moist air for 52 hours at a temperature of approximately 50°C, and showed only very slight tarnishing. The highest value of contact resistance recorded was 0.004 ohms. The electrical contact materials were then further exposed to 100 ppm of $H_2S$ in moist air at room temperature for a period of approximately 10 minutes and the contact resistance data that was obtained was comparable with the data given in the above tables.

Similar improvements in contact performance over the basic silver/copper alloy have been observed for electrical contact materials with a copper concentration in the range 5 to 50 weight per cent and a $La_{1-x}Sr_xCrO_3$ concentration in the range 2 to 20 weight per cent.

It is to be understood that the foregoing description of specific examples of this invention is made by way of example only and is not to be considered as a limitation in its scope.

What is claimed is:

1. A method of producing an electrical contact material including the steps of providing irregular silver powder having a powder particle size of not greater than approximately 350 mesh; providing irregular copper powder having a powder particle size of not greater than approximately 350 mesh; providing lanthanum strontium chromite powder of formula $La_{1-x}Sr_xCrO_3$, where the values lie between 0 and 1.0, and having a powder particle size of not greater than approximately 10 microns; mixing the powders together to provide a fine, evenly dispersed mixture containing 5 to 50 weight per cent of copper, 2 to 20 weight per cent of $La_{1-x}Sr_xCrO_3$ and the remainder silver; compacting the powder mixture into a desired shape; and sintering the compacted shape.

2. A method as claimed in claim 1 wherein the provision of the $La_{1-x}Sr_xCrO_3$ powder includes the steps of mixing La, Sr and Cr nitrates in stoichiometric proportions; spray decomposing the mixed nitrate solution to provide a mixed oxide powder; sintering the oxide powder in air; milling the sintered powder under acetone; and washing the milled powder in dilute hydrochloric acid.

3. A method as claimed in claim 1 wherein the lanthanum, strontium chromite is of formula $La_{0.7}Sr_{0.3}CrO_3$.

4. A method as claimed in claim 2 wherein the lanthanum, strontium chromite is of formula $La_{0.7}Sr_{0.3}CrO_3$.

5. A method as claimed in claim 4 wherein the sintering of the mixed oxide powder is effected for approximately ½ hour at a temperature of approximately 1.250°C.

6. A method as claimed in claim 4 wherein the milling of the sintered powder is effected for 96 hours.

7. A method as claimed in claim 3 wherein the sintering of the powder compact is effected in an atmosphere of 3% hydrogen/97% nitrogen gas mixture at a temperature of 750°C for a period of approximately 1 hour.

8. A method as claimed in claim 1 wherein the compacting of the powder is effected at a pressure of approximately 20 tons per square inch.

9. A method as claimed in claim 1 wherein the powder mixing is effected by dry tumble milling.

10. A method as claimed in claim 1 which includes the step of coining the sintered compacts to increase the density thereof.

11. A method as claimed in claim 10 wherein the coining is effected at a pressure of approximately 50 tons per square inch.

* * * * *